US010610914B2

(12) United States Patent
Zhang et al.

(10) Patent No.: US 10,610,914 B2
(45) Date of Patent: Apr. 7, 2020

(54) ROLLING METHOD FOR BOARDS WITH DIFFERENT LONGITUDINAL THICKNESSES

(71) Applicant: BAOSHAN IRON & STEEL CO., LTD., Shanghai (CN)

(72) Inventors: Chunwei Zhang, Shanghai (CN); Shanqing Li, Shanghai (CN); Zhenglian Jiang, Shanghai (CN); Fei Xiong, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 216 days.

(21) Appl. No.: 15/561,043

(22) PCT Filed: Mar. 29, 2016

(86) PCT No.: PCT/CN2016/077628

§ 371 (c)(1),
(2) Date: Sep. 23, 2017

(87) PCT Pub. No.: WO2016/155603

PCT Pub. Date: Oct. 6, 2016

(65) Prior Publication Data

US 2018/0071803 A1 Mar. 15, 2018

(30) Foreign Application Priority Data

Mar. 30, 2015 (CN) ..... 2015 1 0141809

(51) Int. Cl.
*B21D 37/00* (2006.01)
*B21B 37/26* (2006.01)
(Continued)

(52) U.S. Cl.
CPC ..... *B21B 37/26* (2013.01); *B21B 1/30* (2013.01); *B21B 3/00* (2013.01)

(58) Field of Classification Search
CPC ..... B21B 37/16; B21B 37/58; B21B 37/70; B21D 37/24; B21D 37/26
See application file for complete search history.

(56) References Cited

FOREIGN PATENT DOCUMENTS

CN 103926834 A 12/2008
CN 104338748 2/2015
(Continued)

OTHER PUBLICATIONS

Hiromu Suzuki, "Narratives on rolling (5)", Science of Machine, Japan, Yokendo, Aug. 1989, vol. 41, No. 8, p. 935-941 (Well-known art).

(Continued)

*Primary Examiner* — Debra M Sullivan
(74) *Attorney, Agent, or Firm* — Thomas Horstemeyer, LLP

(57) ABSTRACT

Disclosed is a rolling method for a board having various longitudinal thicknesses, comprising the following steps: 1) setting a number N of uniform-thickness segments of a sample, thicknesses $h_1, h_2, \ldots, h_N$ of the uniform-thickness segments, lengths $L_1, L_2, \ldots, L_N$ of the uniform-thickness segments, and lengths $T_1, T_2, \ldots, T_{N-1}$ of transitional segments between the uniform-thickness segments, the N uniform-thickness segments having N−1 transitional segments therebetween, and both the thickness and length having a unit of mm; 2) selecting a raw material; 3) setting a rolling force, a roll gap and a rolling period of time for each segment; 4) preparing rolling; 5) conducting rolling; 6) optimizing rolling parameters, measuring thicknesses and lengths of the uniform-thickness segments and lengths of the transitional segments after the rolling member is rolled; comparing the measured thicknesses of the uniform-thickness segments with the set thicknesses for the sample, so as to correct the rolling force $P_i$ and roll gap $G_i$ set for each segment in step 3); comparing the measured lengths with the positions marked in step 4), so as to correct the rolling period of time set for each segment in step 3); repeating steps 4) and 5) using raw materials of the same size, and making correction again, wherein a rolled member meeting the require- (Continued)

ments of the sample can be made after 2-3 times of trial rolling. This method avoids preparation of a raw material in the form of a roll, avoids study on a complex controlling method for various-thickness rolling of the roll, and saves the raw material and test time.

1 Claim, 2 Drawing Sheets

(51) Int. Cl.
*B21B 1/30* (2006.01)
*B21B 3/00* (2006.01)

(56) References Cited

FOREIGN PATENT DOCUMENTS

| | | | |
|---|---|---|---|
| CN | 104338748 | A | 2/2015 |
| CN | 104741377 | A | 7/2015 |
| JP | S59035807 | | 2/1984 |
| JP | 6033809 | A | 2/1985 |
| JP | S63290605 | | 11/1988 |
| JP | H03281010 | | 12/1991 |
| JP | H07265924 | | 10/1995 |
| JP | 2002336902 | | 11/2002 |
| JP | 2006305617 | | 11/2006 |
| WO | 2014067037 | A1 | 5/2014 |

OTHER PUBLICATIONS

Hisashi Mori et al. "Evaluation of Workability on Flame Resisting Magnesium Alloy" Report of Railway Technical Research Institute, Japan, Oct. 2011, vol. 25, No. 10, p. 35-38 URL https://www.rtri.or.jp/publish/rtrirep/ (Well-known art).
Japanese Office Action dated Feb. 26, 2019 for JP Patent Application No. 2017-550505.
PCT/CN2016/077628 International Search Report and Written Opinion, dated May 24, 2016.

ROLLING METHOD FOR BOARDS WITH DIFFERENT LONGITUDINAL THICKNESSES

CROSS-REFERENCE TO THE RELATED APPLICATIONS

This application is a 371 U.S. National Phase of PCT International Application No. PCT/CN2016/077628, filed on Mar. 29, 2016, which claimed benefit and priority to Chinese patent application No. 201510141809.0, filed on Mar. 30, 2015. Both of the above-referenced applications are incorporated by reference herein in their entirety.

TECHNICAL FIELD

The disclosure relates to a rolling technology for manufacture of a board, particularly to a rolling method for manufacture of a board having various longitudinal thicknesses.

BACKGROUND ART

In order to realize the object of vehicle lightening, use of a strip having a continuously varying longitudinal thickness manufactured by rolling, VRB (various-thickness rolled blank), is currently under promotion in the vehicle industry.

The rolling technology for manufacture of VRBs is named flexible rolling, originating from a program sponsored by German Research Foundation (DFG) in 1997. As a participant in the program at that time, Mubea Company is the main supplier of VRBs in the present market. The core of the flexible rolling technology is to achieve variation of an exit thickness by adjusting roll gap (see FIG. 1).

For ensuring production efficiency, cold-rolled boards of VRBs are industrially produced in the form of rolls (see FIG. 2).

At a developmental stage of a product, there is usually a need of only a few pieces of VRBs for material property testing, shaping testing, etc. At this time, the form of a roll appears less flexible, not only wasting the material, but also adding subsequent process steps of straightening and cutting.

SUMMARY OF THE INVENTION

An object of the disclosure is to provide a rolling method for manufacture of a board having various longitudinal thicknesses, wherein subsequent process steps such as straightening, cutting and the like in connection to rolling of a VRB in the form of a roll in the current industry are exempted, and a board having various set longitudinal thicknesses can be provided conveniently and rapidly at a developmental stage of a product.

The various-thickness board having various longitudinal thicknesses obtained by rolling (VRB) generally has a shape shown by FIG. 2.

At a developmental stage of a product, there is a need to subject boards of different materials and shapes to property analysis and shaping testing. At this stage, the amount of a non-uniform-thickness board of the same type that is demanded is not very large. If it is produced in the form of a roll, not only the production is not economical, but subsequent process steps such as straightening, cutting and the like will also be added. These steps also take certain time.

Therefore, the disclosure proposes a solution where non-uniform-thickness rolling is conducted on an ordinary single rolling mill, with the aim of manufacture of a single board having various longitudinal thicknesses by rolling in a simple and flexible manner.

The rolling method for manufacture of a board having various longitudinal thicknesses comprises the following steps:

1) setting a number N of uniform-thickness segments for a sample, thicknesses $h_1, h_2, \ldots, h_N$ of the uniform-thickness segments, lengths $L_1, L_2, \ldots, L_N$ of the uniform-thickness segments, and lengths $T_1, T_2, \ldots, T_{N-1}$ of transitional segments between the uniform-thickness segments, wherein the N segments have N−1 transitional segments therebetween, and both the thickness and length have a unit of mm;

2) selecting a raw material having thickness: $H \succ \max(h_1, h_2, \ldots, h_N)$, unit: mm;

length:

$$L = \frac{\sum_{i=1}^{N}(L_i \times h_i) + \sum_{i=1}^{N-1}\frac{T_i \times (h_i + h_{i+1})}{2}}{H},$$

unit: mm;

the raw material needed thus has a length of L0+L, unit: mm; wherein L0 is a sum of a clamp length and an allowance of a roller entrance;

3) setting a rolling force, a roll gap and a rolling period of time for each segment i) calculation of the rolling force $$P_i = f(H, h_i, b, R, \mu, t_f, t_b, T, \dot{\varepsilon}, \sigma_{s0}) \quad (1)$$

wherein $P_i$—the rolling force set for the $i^{th}$ uniform-thickness segment, kN;

H, $h_i$—thickness of a rolling member at an entrance and thickness of the rolling member at an exit of the $i^{th}$ uniform-thickness segment, mm;

b—width of the rolling member, mm;

R—radius of a working roller, mm;

$\sigma_{s0}$—initial yield stress of a strip, kN/mm$^2$;

μ—friction coefficient between the working roller and the rolling member, 0.02-0.12;

$t_b$, $t_f$—back tension and front tension applied by the clamp to the rolling member, MPa;

T—rolling temperature, ° C.;

$\dot{\varepsilon}$—deformation rate, $s^{-1}$, calculated using Ekelend formula:

$$\dot{\varepsilon} = f(V_r, R, H, h_i, b, C_H, P_i)$$

$V_r$—stand velocity, m/min;

$C_H$—Young's modulus of the rolling member, MPa;

ii) calculation of the roll gap according to the spring equation of the rolling mill:

$$G_i = h_i - \frac{P_i}{M} \quad (2)$$

wherein $G_i$—the roll gap set for the $i^{th}$ uniform-thickness segment, mm;

$P_i$—the rolling force set for the $i^{th}$ uniform-thickness segment, kN;

M—stiffness of the stand, kN/mm which is an intrinsic parameter of the stand and is measured before rolling begins;

iii) calculation of the rolling period of time:

$$t_{2i-1}=L_i/V_r \text{ or } t_{2i}=T_i/V_r \quad (3)$$

wherein $L_i$, $T_i$—length of the $i^{th}$ uniform-thickness segment and length of the $i^{th}$ transitional segment, mm;

$V_r$—rolling velocity, mm/s;

4) preparing rolling marking start and end points of the uniform-thickness segments and the transitional segments on the raw material based on the constant volume principle in view of a required sample shape with width spread ignored, wherein the lengths of the uniform-thickness segments and the transitional segments are calculated as follows:

$$L_{i_0} = \frac{L_i \times h_i}{H}, \text{ mm;}$$

$$T_{i_0} = \frac{T_i \times (h_i + h_{i+1})}{2 \times H}, \text{ mm;}$$

5) rolling conducting rolling using the set values calculated according to step 3);

6) optimizing rolling parameters measuring thicknesses and lengths of the uniform-thickness segments and lengths of the transitional segments after the rolling member is rolled; comparing the measured thicknesses of the uniform-thickness segments with the set thicknesses for the sample, so as to correct the rolling force $P_i$ and roll gap $G_i$ set for each segment in step 3); comparing the measured lengths with the positions marked in step 4), so as to correct the rolling period of time set for each segment in step 3); repeating steps 4) and 5) using raw materials of the same size, and making correction again, wherein a rolled member meeting the requirements of the sample can be made after 2-3 times of trial rolling.

The beneficial effects of the disclosure include:

According to the method of the disclosure, a single qualified various-thickness board can be made using data optimized by several times of rolling on a single reciprocating test rolling mill. In this manner, it's unnecessary to prepare a raw material in the form of a roll, so that the raw material is saved. It's also unnecessary to study the complex controlling method for various-thickness rolling of a roll of the raw material, so that test time is saved. The method of the disclosure is particularly suitable for providing a test material for a product at an early developmental stage.

In addition, as the boundary conditions such as velocity, temperature and the like in the single-piece rolling are completely the same, the method can be used to study the properties of a magnesium alloy board at various percentages of reduction.

DETAILED DESCRIPTION OF THE INVENTION

The disclosure will be further illustrated with reference to the following Examples and accompanying drawings.

Figure 1:
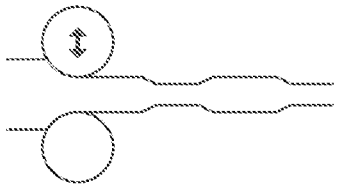
FIG. 1 is a schematic view of flexible rolling.
Figure 2:
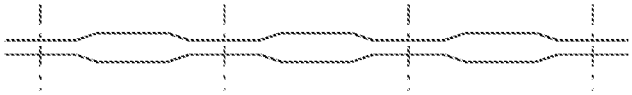
FIG. 2 is a schematic view of a thickness profile of a board having a periodically varying longitudinal thickness according to the disclosure.
Figure 3:
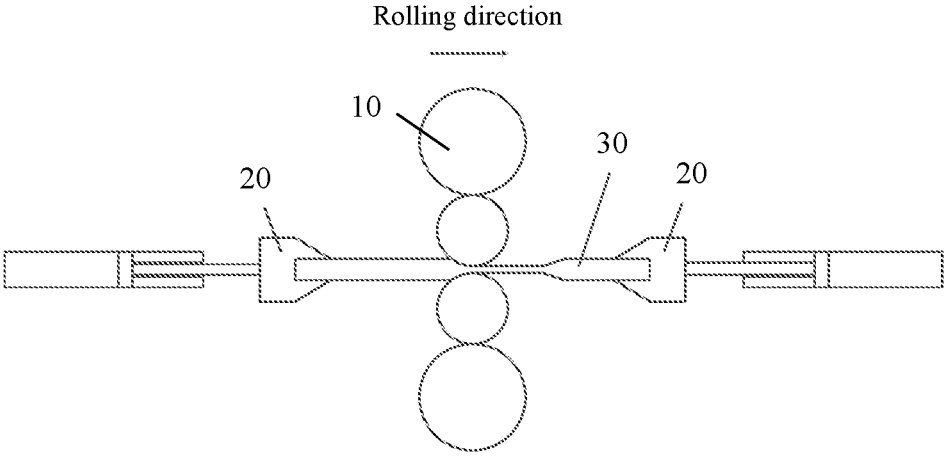
FIG. 3 is a schematic view showing manufacture of a non-uniform-thickness board on a single rolling mill.
Figure 4:
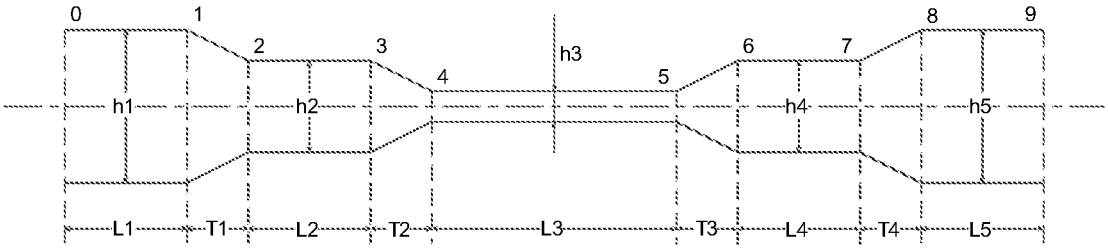
FIG. 4 is a schematic view of a shape of a non-uniform-thickness sample.

As shown by FIG. 3, a common single rolling mill is used to conduct non-uniform-thickness rolling according to the disclosure, so as to manufacture, for example, a non-uniform-thickness board shown in FIG. 4, wherein 10 represents rolling mill, 20 represents clamp, and 30 represents board. Specifically, the manufacture is conducted according to the following steps:

1) setting a number N=5 of uniform-thickness segments for a sample, thicknesses $h_1$, $h_2$, $h_3$, $h_4$, $h_5$ of the uniform-thickness segments, lengths $L_1$, $L_2$, $L_3$, $L_4$, $L_5$ of the uniform-thickness segments, and lengths $T_1$, $T_2$, $T_3$, $T_4$ of transitional segments between the uniform-thickness segments, wherein the 5 segments have 4 transitional segments therebetween, and both the thickness and length have a unit of mm;

2) selecting a raw material having thickness: $H \succ \max(h_1, h_2, h_3, h_4, h_5)$, unit: mm;

length: the length of the clamp and the entrance balance of the roller should be taken into consideration; the length of this part is assumed to be L0; the extension of the board should also be taken into consideration; based on the constant volume principle and ignoring width spread, the length of this part can be calculated using the following formula:

$$L = \frac{\sum_{i=1}^{5}(L_i \times h_i) + \sum_{i=1}^{4}\frac{T_i \times (h_i + h_{i+1})}{2}}{H} \text{ (mm)}$$

hence, the length of the raw material needed is L0+L (mm).

3) determining set values: for the shape shown by FIG. 4, setting is conducted as follows (see formulae (1), (2), (3) for the methods for setting roll gap, rolling force and rolling period of time)

| No. | Longitudinal Position | Setting roll gap | Setting rolling force | Setting rolling period of time |
|---|---|---|---|---|
| 0 | 0 | $G_1$ | $P_1$ | 0 |
| 1 | $L_1$ | $G_1$ | $P_1$ | $t_1$ |
| 2 | $L_1 + T_1$ | $G_2$ | $P_2$ | $t_2$ |
| 3 | $L_1 + T_1 + L_2$ | $G_2$ | $P_2$ | $t_3$ |
| 4 | $L_1 + T_1 + L_2 + T_2$ | $G_3$ | $P_3$ | $t_4$ |
| 5 | $L_1 + T_1 + L_2 + T_2 + L_3$ | $G_3$ | $P_3$ | $t_5$ |
| 6 | $L_1 + T_1 + L_2 + T_2 + L_3 + T_3$ | $G_4$ | $P_4$ | $t_6$ |
| 7 | $L_1 + T_1 + L_2 + T_2 + L_3 + T_3 + L_4$ | $G_4$ | $P_4$ | $t_7$ |
| 8 | $L_1 + T_1 + L_2 + T_2 + L_3 + T_3 + L_4 + T_5$ | $G_5$ | $P_5$ | $t_8$ |
| 9 | $L_1 + T_1 + L_2 + T_2 + L_3 + T_3 + L_4 + T_5 + L_5$ | $G_5$ | $P_5$ | $t_9$ |

The thickness of a uniform-thickness segment of the rolling member is determined by a roll gap $G_i$ or a rolling force $P_i$, and the lengths of a uniform-thickness segment and a transitional segment are determined by a rolling period of time $t_i$. The actual rolling effect is related with the rolling velocity. Hence, the rolling velocity should be set first for the rolling, so that the rolling can be conducted at a constant velocity $V_r$.

The maximum loaded pressing velocity of the rolling mill is $V_p$. Hence, $$\Delta h_i = \frac{V_p \times T_i}{V_r} \ (\Delta h_i = h_{i+1} - h_i) \ (i = 1, 2, \ldots, 5);$$

The rolling velocity must meet the following relationship:

$$V_r \leq \frac{V_p \times T_i}{\Delta h_i} \ (\text{mm/s}) \ (i = 1, 2, \ldots, 5);$$

4) preparing rolling

Adjustment of the controlling values: as described above, the set values for controlling the rolling include roll gaps, rolling forces and rolling periods of time for the uniform-thickness segments. In real rolling, the shape of the rolling member is usually different from the set shape due to variation of the board strength, fluctuation of the rolling velocity of the board and other factors. Therefore, the set values need to be adjusted in light of the shape of the rolling member after rolling. A simple method is as follows:

Making marks on the original board: in view of the required shape after rolling, points 0 . . . 9 are marked on the original board correspondingly based on the constant volume principle with width spread ignored, wherein the lengths of the uniform-thickness segments and the transitional segments can be calculated respectively as follows:

$$L_{i_0} = \frac{L_i \times h_i}{H} \ (i = 1 \ldots 5)$$

$$T_{i_0} = \frac{T_i \times (h_i + h_{i+1})}{2 \times H} \ (i = 1 \ldots 4)$$

5) rolling

Setting is conducted according to step 3) and rolling is conducted;

6) optimizing rolling parameters

Measuring thicknesses and lengths of the uniform-thickness segments and lengths of the transitional segments after the rolling member is rolled; comparing the measured thicknesses of the uniform-thickness segments with the set thicknesses for the sample, so as to correct the rolling force $P_i$ and roll gap $G_i$ set for each segment in step 3); comparing the measured lengths with the positions marked in step 4), so as to correct the rolling period of time set for each segment in step 3); repeating steps 4) and 5) using raw materials of the same size, and making correction again, wherein a rolled member meeting the requirements of the sample can be made after 2-3 times of trial rolling.

The method of the disclosure can be carried out on a single reciprocating rolling mill only with the need of some modification to the control system. The method can be popularized in the research area of various-thickness boards. As vehicle lightening gains increasing attention, this technology will have a prospect as wide as that of VRB.

In addition, the method of the disclosure can also be applied to manufacture of another lightweight material—magnesium alloy. Temperature and rolling speed are very crucial factors for rolling magnesium alloy boards. Use of this technology on a single warm rolling mill allows various percentages of reduction of the boards when completely identical boundary conditions are ensured. This is of great significance for study on properties of magnesium alloy boards.

What is claimed is:

1. A rolling method for manufacture of a board having various longitudinal thicknesses, comprising the following steps:

1) setting a number N of uniform-thickness segments for a sample, thicknesses $h_1, h_2, \ldots, h_N$ of the uniform-thickness segments, lengths $L_1, L_2, \ldots, L_N$ of the uniform-thickness segments, and lengths $T_1, T_2, \ldots, T_{N-1}$ of transitional segments between the uniform-thickness segments, wherein the N segments have N−1 transitional segments there between, and both the thickness and length have a unit of mm;

2) selecting a raw material having the following properties thickness: $H \succ \max(h_1, h_2, \ldots, h_N)$, unit: mm;

length:

$$L = \frac{\sum_{i=1}^{N} (L_i \times h_i) + \sum_{i=1}^{N-1} \frac{T_i \times (h_i + h_{i+1})}{2}}{H}, \text{ unit mm};$$

the raw material needed thus has a length of L0+L unit: mm; wherein L0 is a sum of a clamp length and an allowance of a roller entrance;

3) setting a rolling force, a roll gap and a rolling period of time for each segment i) calculation of the rolling force $$P_i = f(H, h_i, b, R, \mu, t_f, t_b, T, \dot{\varepsilon}, \sigma_{s0}) \quad (1)$$

wherein $P_i$—the rolling force set for the $i^{th}$ uniform-thickness segment, kN;

H, $h_i$—thickness of a rolling member at an entrance and thickness of the rolling member at an exit of the $i^{th}$ uniform-thickness segment, mm;

b—width of the rolling member, mm;

R—radius of a working roller, mm;

$\sigma_{s0}$—initial yield stress of a strip, kN/mm$^2$;

μ—friction coefficient between the working roller and the rolling member, 0.02-0.12;

$t_b$, $t_f$—back tension and front tension applied by the clamp to the rolling member, MPa;

T—rolling temperature, ° C.;

$\dot{\varepsilon}$—deformation rate, $s^{-1}$, calculated using Ekelend formula:

$$\dot{\varepsilon} = f(V_r, R, H, h_i, b, C_H, P_i)$$

$V_r$—stand velocity, m/min;

$C_H$—Young's modulus of the rolling member, MPa;

ii) calculation of the roll gap according to the spring equation of a rolling mill:

$$G_i = h_i - \frac{P_i}{M} \quad (2)$$

wherein $G_i$—the roll gap set for the $i^{th}$ uniform-thickness segment, mm;

$P_i$—the rolling force set for the $i^{th}$ uniform-thickness segment, kN;

M—stiffness of the stand, kN/mm, which is an intrinsic parameter of a stand and is measured before rolling begins;

iii) calculation of the rolling period of time:

$$t_{2i-1}=L_i/V_r \text{ or } t_{2i}=T_i/V_r \quad (3)$$

wherein $L_i$, $T_i$—length of the $i^{th}$ uniform-thickness segment and length of the $i^{th}$ transitional segment, mm; $V_r$—rolling velocity, mm/s;

4) preparing rolling marking start and end points of the uniform-thickness segments and the transitional segments on the raw material based on the constant volume principle in view of a required sample shape with width spread ignored, wherein the lengths of the uniform-thickness segments and the transitional segments are calculated as follows:

$$L_{i_0} = \frac{L_i \times h_i}{H}, \text{ mm;}$$

$$T_{i_0} = \frac{T_i \times (h_i + h_{i+1})}{2 \times H}, \text{ mm;}$$

5) rolling conducting rolling using the set values calculated according to step 3);

6) optimizing rolling parameters measuring thicknesses and lengths of the uniform-thickness segments and lengths of the transitional segments after the rolling member is rolled; comparing the measured thicknesses of the uniform-thickness segments with the set thicknesses for the sample, so as to correct the rolling force $P_i$ and roll gap $G_i$ set for each segment in step 3); comparing the measured lengths with the positions marked in step 4), so as to correct the rolling period of time set for each segment in step 3); repeating steps 4) and 5) using raw materials of the same size, and making correction again, wherein a rolled member meeting the requirements of the sample can be made after 2-3 times of trial rolling.

* * * * *